United States Patent [19]

Cyrana et al.

[11] Patent Number: 5,065,191

[45] Date of Patent: Nov. 12, 1991

[54] ADJUSTMENT OF MICR SIGNAL STRENGTH

[75] Inventors: Edward M. Cyrana, Webster; Douglas B. Strong, Penfield; Allan R. Amering, Hilton, all of N.Y.

[73] Assignee: Eastman Kodak Company, Rochester, N.Y.

[21] Appl. No.: 548,411

[22] Filed: Jul. 5, 1990

[51] Int. Cl.[5] ..... G03G 21/00

[52] U.S. Cl. ..... 355/246; 355/208

[58] Field of Search ..... 355/246, 203, 208, 228, 355/69; 346/153.1

[56] References Cited

U.S. PATENT DOCUMENTS

| | | | |
|---|---|---|---|
| 3,712,733 | 1/1973 | Giaimo, Jr. | 355/245 X |
| 4,534,642 | 8/1985 | Miura et al. | 355/246 X |
| 4,563,086 | 2/1986 | Knapp et al. | 355/246 |
| 4,924,263 | 5/1990 | Bares | 355/203 |
| 4,965,613 | 10/1990 | Morris et al. | 355/208 X |

FOREIGN PATENT DOCUMENTS

| | | |
|---|---|---|
| 0161556 | 12/1981 | Japan . |
| 0172655 | 10/1983 | Japan . |

*Primary Examiner*—A. T. Grimley
*Assistant Examiner*—Nestor R. Ramirez
*Attorney, Agent, or Firm*—Milton S. Sales

[57] ABSTRACT

Control of the magnetic signal strength of magnetic images is attained selectively (1) by adjusting exposure and (2) by adjusting the toner concentration, wherein the signal strength control is by way of controlling exposure rather by adjusting the toner concentration whenever the desired amount of signal strength control can be attained by adjusting the amount of exposure. Generally, the amount of attainable exposure has minimum and maximum limits; and the toner concentration is adjusted only when an exposure value change is called for which would cause the exposure to exceed those limits. When the toner concentration does need to be adjusted, an excessive amount of adjustment will stop the apparatus and request service. To increase the signal strength of the MICR image, toner replenishment is permitted to continue only for a predetermined amount of time. To decrease the signal strength of the MICR image, high-density prints are generated without replenishing the toner particles.

2 Claims, 3 Drawing Sheets

ADJUSTMENT OF MICR SIGNAL STRENGTH

BACKGROUND OF THE INVENTION

1. Technical Field

This invention relates generally to producing machine-readable documents using magnetic toners, and more particularly to controlling the magnetic signal strength of the magnetic images.

2. Background Art

The use of magnetic toner for creating magnetic image character recognition (MICR) such as used for bank checks is well known. U.S. Pat. No. 4,563,086 to Knapp et al. discloses such a printer wherein the intensity of the magnetic field generated by the toner image is detected and used to regulate various process control parameters of the printer; including photoconductor charging, exposure, development bias, toner concentration, and transfer voltage.

Often, users of MICR printers and copiers find that it is necessary or desirable to adjust the magnetic signal strength of the image. The need for this ability arises from a number of variables such as environmental conditions, paper type, the age and condition of the photoconductor, and the user's preference. For example, some characters are formed with more toner than are other characters, and a character chain containing a greater percentage of the former characters would exhibit a greater overall signal strength than a chain containing a lesser percentage of the former characters. Accordingly, a user might wish to decrease the signal strength of each character when reproducing chains containing a greater percentage of the former characters. Another example of when a user might wish to adjust the MICR signal strength is when the character orientation changes between landscape and portrait mode. The sharpness of the leading edge of a character is affected by its orientation relative to the direction of movement of the edge through the development station, and a sharp leading edge tends to produce a greater MICR signal strength.

Because of their complexity, prior art processes for adjusting MICR signal strength often require highly skilled workers, such as field engineers or technical representative service persons.

When the magnetic signal strength is adjusted by means of regulation of the concentration of magnetic toner particles in the development mixture, as is done in said U.S. Pat. No. 4,563,086, added toner particles must be thoroughly mixed into the developer before a print is produced, and toner can be removed from the mixture only by producing many wasted prints. This slows the adjustment process and makes it difficult to effect. Over adjustments are cumbersome to recover from.

DISCLOSURE OF INVENTION

It is an object of the present invention to provide users of MICR reproduction apparatus with the ability to readily adjust the magnetic signal strength of a MICR image within a defined range without affecting the concentration of toner particles in the development mixture.

It is another object of the present invention to provide for the adjustment of the magnetic signal strength of a MICR image by changing the exposure value within a defined range, and by adjusting the toner concentration only when that range would be exceeded.

It is yet another object of the present invention to provide for easy adjustment of the magnetic signal strength of a MICR image by relatively unskilled operators.

The present invention provides for controlling the magnetic signal strength of magnetic images selectively (1) by adjusting exposure and (2) by adjusting the toner concentration, wherein the signal strength control is by means of controlling exposure rather than by adjusting the toner concentration whenever the desired amount of signal strength control can be attained by adjusting the amount of exposure. Generally, the amount of attainable exposure has minimum and maximum limits; and the toner concentration is adjusted only when an exposure value change is called for which would cause the exposure to exceed those limits. When the toner concentration does need to be adjusted, an excessive amount of adjustment will stop the apparatus and request service.

The invention, and its objects and advantages, will become more apparent in the detailed description of the preferred embodiments presented below.

BRIEF DESCRIPTION OF THE DRAWINGS

In the detailed description of the preferred embodiments of the invention presented below, reference is made to the accompanying drawings which.

BEST MODE FOR CARRYING OUT THE INVENTION

Figure 1:
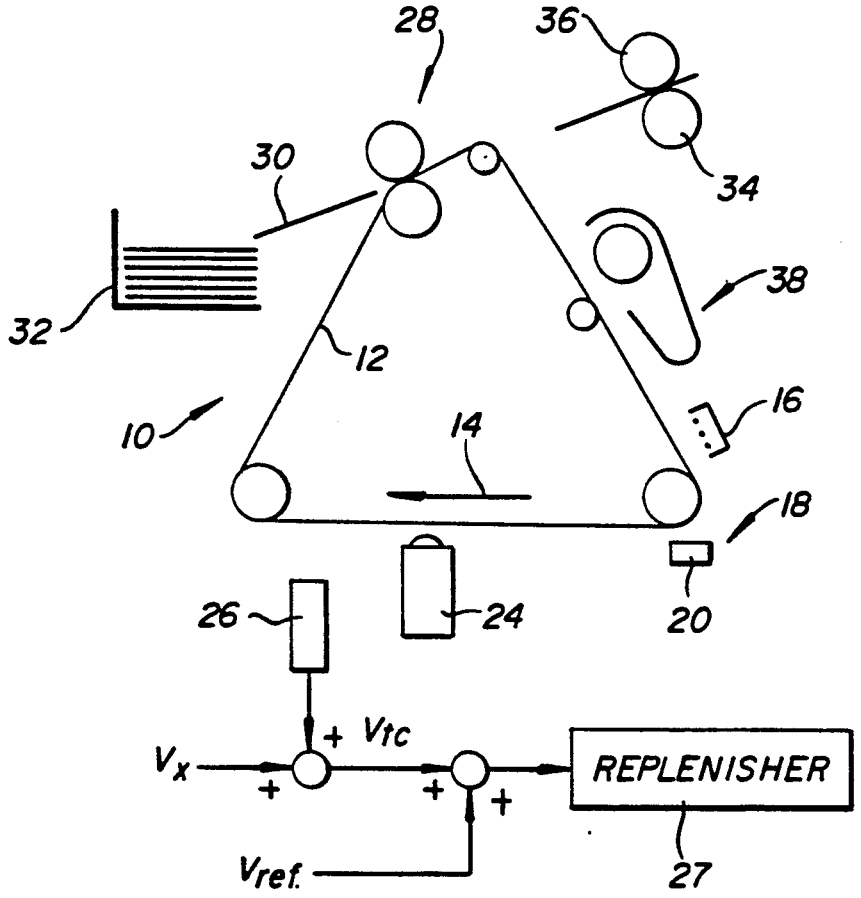
FIG. 1 is a schematic block diagram of reproduction apparatus according to a preferred embodiment of the present invention.

The present description will be directed in particular to elements forming part of, or cooperating more directly with, apparatus in accordance with the present invention. It is to be understood that elements of the preferred embodiment that are not specifically shown or described may take various forms well known to those skilled in the art.

Referring to the drawing, an electrostatographic document reproduction apparatus 10 such as a copier or printer has an image transfer member such as a photoconductive belt 12, which is moved in a clockwise direction as represented by an arrow 14.

A charging station 16 applies an electrostatic charge to belt 12. At an exposure station 18, projected light from a write head 20 imagewise dissipates the electrostatic charge on the photoconductive belt to form a latent electrostatic image corresponding to the image to be copied or printed. Write head 20 preferably has an array of light-emitting diodes (LEDs) for exposing the photoconductive belt, but it is to be understood that other technologies are equally applicable to the present invention. For example, the apparatus may be an optical copier, stylus or pin recorder, etc.

The latent electrostatic image on belt 12 is developed with magnetic toner at a development station 24, where a magnetic brush development system advances magnetic toner-type developer mixture into contact with the electrostatic latent images. A conventional toner monitor 26 produces a signal characteristic of the reflectivity of the development mixture in station 24. Since the reflectivity of the mixture is a function of the concentration of toner particles in the mixture, the signal from the monitor is, in effect, a toner concentration signal. To that signal, an offset voltage $V_x$ is added to produce a toner concentration signal $V_{tc}$. Signal $V_{tc}$ is compared to a reference voltage $V_{ref}$ to produce an error signal for controlling toner replenisher 27.

As the MICR toner image on belt 12 approaches a transfer station 28, an image receiver sheet 30 is fed from a supply 32. After transfer of the toner image to the receiver sheet, the receiver sheet separates from the belt and is passed through a pair of heated fuser rollers 34 and 36. Mechanical and electrical cleaning of belt 12 is effected at a cleaning station 38.

The signal strength of the MICR image can be sensed either while the toner image is on belt 12 or after the image has been transferred to the receiver sheet. In any event, a user may wish to adjust the signal strength up or down according to the criteria discussed above.

Figure 2:
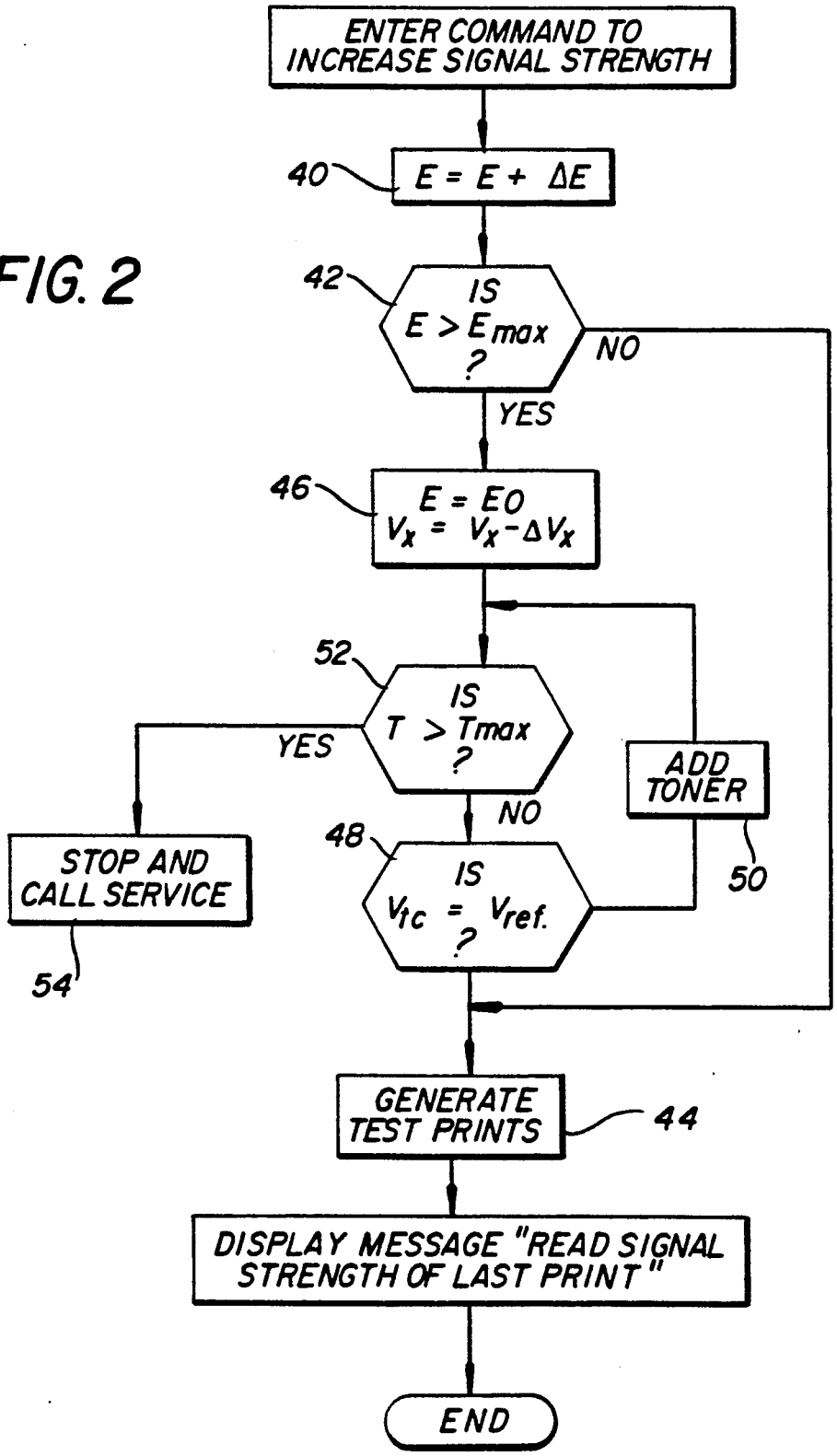
FIGS. 2 and 3 are logic flow charts illustrating operation of the apparatus of FIG. 1.

FIG. 2 is a flow chart describing the operation of the apparatus for increasing the signal strength of the MICR image. First, as shown in logic block 40, the exposure value "E" is increased by a predetermined increment $\Delta E$. This may adjust the power of exposure lamps or increase the exposure time for each pixel to be printed.

There is, of course, a maximum attainable exposure value $E_{max}$. If $E_{max}$ would not be exceeded as determined at 42, at least one but preferably a plurality of test prints are generated (block 44) for use by the operator to determine if the correction was sufficient.

A positive decision at block 42 is an indication that $E_{max}$ would be exceeded in an attempt to increase the signal strength by adjustment of exposure, and that that solution for increasing signal strength is unavailable. Accordingly, the toner concentration in development station 24 must be increased. To do so, the exposure value E is reset to a nominal value "$E_O$" and offset voltage $V_x$ is decreased by a predetermined incremental amount $\Delta V_x$ to reduce toner concentration signal $V_{tc}$ by $\Delta V_x$ (block 46). Now when $V_{tc}$ is compared to $V_{ref}$ at block 48, toner replenisher 27 is actuated (block 50) to add toner to the development mixture.

There is a practical limit to the amount of toner which should be added to the development mixture. An unsuccessful attempt to exceed that limit could indicate that there is a malfunction in the system, or that the operator has requested an unreasonable signal strength. As such, the replenishment cycle is permitted to continue for only a predetermined, limited time period $T_{max}$ before block 52 causes the system to stop and call for service (block 54).

Once $V_{tc}$ reaches $V_{ref}$ and the development mixture is well mixed, at least one but preferably a plurality of test prints are generated (block 44) for use by the operator to determine if the correction was sufficient.

Figure 3:
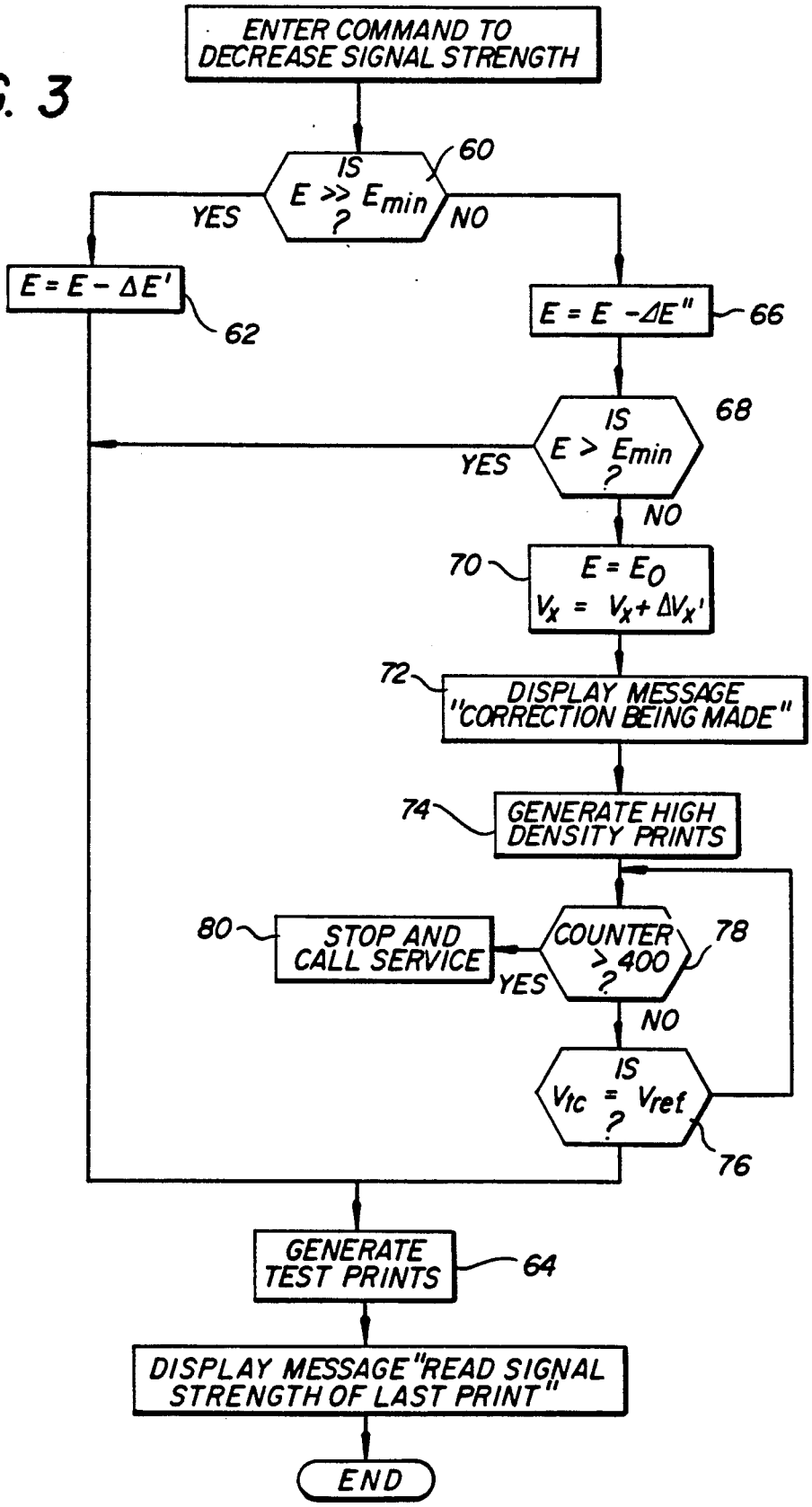

FIG. 3 is a flow chart describing the operation of the apparatus for decreasing the signal strength of the MICR image. If exposure value "E" is not already close to its practical lower limit as determined at block 60, it is decreased by a predetermined increment $\Delta E'$ (block 62). This may adjust the power of exposure lamps or the exposure time for each pixel to be printed. At least one but preferably a plurality of test prints are generated (block 64) for use by the operator to determine if the correction was sufficient.

A negative decision at block 60 is an indication that the exposure value is close to its practical lower limit $E_{min}$. In this event, the exposure value is decreased by some amount $\Delta E''$ which is less than $\Delta E'$ (block 66). If the exposure value is still above $E_{min}$ after this adjustment, at least one but preferably a plurality of test prints are generated (block 64) for use by the operator to determine if the correction was sufficient.

If the adjustment of the exposure value would cause it to fall below its minimum $E_{min}$ in an attempt to decrease the signal strength by adjustment of exposure, as determined at block 68, that solution for decreasing signal strength is unavailable. Accordingly, the toner concentration in development station 24 must be decreased. To do so, the exposure value E is reset to it nominal value "$E_O$" and offset voltage $V_x$ is increased by a predetermined incremental amount $\Delta V_x'$ to increase toner concentration signal $V_{tc}$ by $\Delta V_x'$ (block 70). The operator is advised at block 72 that a correction process is being effected, and a plurality of high density prints are produced (block 74) to use up toner particles from the development mixture; thereby decreasing the toner concentration of the mixture. This process continues until $V_{tc}$ equals $V_{ref}$ as determined at block 76.

There is a practical limit to the amount of toner which should be removed from the development mixture by producing prints. As such, the print cycle is permitted to continue for only a predetermined, limited time number of prints, such as for example the 400 prints shown in FIG. 3, before block 78 causes the system to stop and call for service (block 80).

Once $V_{tc}$ reaches $V_{ref}$, at least one but preferably a plurality of test prints are generated (block 64) for use by the operator to determine if the correction was sufficient.

The invention has been described in detail with particular reference to preferred embodiments thereof, but it will be understood that variations and modifications can be effected within the spirit and scope of the invention.

What is claimed is:

1. An electrostatographic apparatus for producing documents with machine-readable magnetic images using magnetic toners and having magnetic signal strengths which are characteristic of the amount of toner in the images, said apparatus comprising:

an image transfer member;

means for imagewise exposing said image transfer member to produce an electrostatic latent image;

actuatable means for adjusting the amount of exposure effected by said exposing means;

a development station containing a development mixture of magnetic toner and carrier particles, and being adapted to develop said latent images with said magnetic toner particles;

means for controlling the magnetic signal strength of magnetic images a desired amount selectively (1) by actuating said exposure adjusting means and (2) by adjusting the ratio of toner particles to carrier particles in said development mixture, said signal strength controlling means being adapted to actuate said exposure adjusting means rather than to adjust said ratio of toner particles to carrier particles whenever the desired amount of signal strength control can be attained by adjusting the amount of exposure effected by said exposing means, wherein said signal strength controlling means is adapted to incrementally add toner particles to said development mixture until a proper concentration of particles is attained or a predetermined period of time has elapsed, whichever occurs first.

2. An electrostatographic apparatus for producing documents with machine-readable magnetic images using magnetic toners and having magnetic signal strengths which are characteristic of the amount of toner in the images, said apparatus comprising:

an image transfer member;

means for imagewise exposing said image transfer member to produce an electrostatic latent image;

actuatable means for adjusting the amount of exposure effected by said exposing means;

a development station containing a development mixture of magnetic toner and carrier particles, and being adapted to develop said latent images with said magnetic toner particles;

means for controlling the magnetic signal strength of magnetic images a desired amount selectively (1) by actuating said exposure adjusting means and (2) by adjusting the ratio of toner particles to carrier particles in said development mixture, said signal strength controlling means being adapted to actuate said exposure adjusting means rather than to adjust said ratio of toner particles to carrier particles whenever the desired amount of signal strength control can be attained by adjusting the amount of exposure effected by said exposing means, wherein said signal strength controlling means is adapted to remove toner particles from said development mixture by producing printed documents without replenishing the toner particles thereby used until a proper concentration of particles is attained or a predetermined number of printed documents have been produced, whichever occurs first.

* * * * *